US008915826B2

(12) United States Patent
Publicover et al.

(10) Patent No.: US 8,915,826 B2
(45) **Date of Patent: *Dec. 23, 2014**

(54) HOPPING BALL

(71) Applicant: Mark W. Publicover, Saratoga, CA (US)

(72) Inventors: Mark W. Publicover, Saratoga, CA (US); Jon Patton Hylbert, Los Gatos, CA (US); Donald Strasser, Los Gatos, CA (US)

(73) Assignee: Mark W. Publicover, Saratoga, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/851,058

(22) Filed: Mar. 26, 2013

(65) Prior Publication Data

US 2013/0296140 A1 Nov. 7, 2013

Related U.S. Application Data

(63) Continuation of application No. 13/184,449, filed on Jul. 15, 2011, now abandoned, which is a continuation (Continued)

(51) Int. Cl.

| | |
|---|---|
| ***A63B 21/00*** | (2006.01) |
| ***A63B 41/02*** | (2006.01) |
| ***B05B 17/00*** | (2006.01) |
| ***A63B 43/06*** | (2006.01) |
| ***A63B 41/00*** | (2006.01) |

(52) U.S. Cl.

CPC ..... *A63B 41/02* (2013.01); *A63B 2220/17* (2013.01); *B05B 17/00* (2013.01); *A63B 43/06* (2013.01); *A63B 41/00* (2013.01)

USPC ..... 482/77; 482/148; 239/289; 239/333; 472/128

(58) Field of Classification Search

USPC ..... 482/77, 148; 239/289, 333; 472/128, 472/134, 122; 446/180, 183, 220, 267, 475

See application file for complete search history.

(56) References Cited

U.S. PATENT DOCUMENTS 1,292,618 A * 1/1919 Lazelle ..... 446/159
2,004,866 A 6/1935 Haldeman (Continued)

FOREIGN PATENT DOCUMENTS

DE 10 2006 015 2 10/2006
GB 2226769 11/1990

OTHER PUBLICATIONS

International Preliminary Report on Patentability and Written Opinion of the International Searching Authority, mailed Mar. 3, 2008, for International Application No. PCT/US2006/033615.

(Continued)

*Primary Examiner* — Jerome w Donnelly
(74) *Attorney, Agent, or Firm* — Klarquist Sparkman, LLP

(57) ABSTRACT

A hopping play ball comprises a pair of elongated grips or handles adjacent to each other and extending radially outward from the surface of the ball. The ball may also comprise an array of mammillated protrusions on the lower surface, opposite the handles, to improve the stability during bouncing on a soft or elastic surface, such as a trampoline rebounding mat. In other embodiments, the ball has one or more water reservoirs in fluid communication with squirt nozzles disposed on either the surface of the ball or an outward facing portion of the handles. The squirt nozzles are activated by the player via the handle grips, and may pump or squirt water in response to each bounce or may be triggered independent of the players bouncing movement. The mammillated surface aids in preventing slippage of the balls during such types of wet play with multiple players.

7 Claims, 7 Drawing Sheets

Related U.S. Application Data of application No. 13/098,369, filed on Apr. 29, 2011, now abandoned, which is a continuation of application No. 12/037,032, filed on Feb. 25, 2008, now Pat. No. 7,938,758, which is a continuation-in-part of application No. PCT/US2006/033615, filed on Aug. 28, 2006.

(60) Provisional application No. 60/712,713, filed on Aug. 30, 2005.

(56) References Cited

U.S. PATENT DOCUMENTS

| | | | | |
|---|---|---|---|---|
| 2,619,257 | A | 11/1952 | Posner | |
| 2,735,589 | A | 2/1956 | Milster et al. | |
| 2,741,400 | A | 4/1956 | Hazzard | |
| 2,960,794 | A | 11/1960 | Johns | |
| 3,048,395 | A | 8/1962 | Hobbs | |
| 3,088,675 | A | 5/1963 | Bone | |
| 3,098,317 | A | 7/1963 | Guzman | |
| 3,122,130 | A | 2/1964 | Brown et al. | |
| 3,134,505 | A | 5/1964 | Modderno | |
| 3,142,932 | A | 8/1964 | Lemelson | |
| 3,179,409 | A | 4/1965 | Marino | |
| 3,388,835 | A | 6/1968 | Naughten | |
| 3,509,584 | A | 5/1970 | Sable | |
| 3,520,534 | A | 7/1970 | Bennett et al. | |
| 3,627,314 | A | 12/1971 | Brown | |
| D222,807 | S | 1/1972 | Davis | |
| D223,675 | S | 5/1972 | Raphael | |
| 4,164,284 | A | 8/1979 | Witt et al. | |
| 4,280,297 | A | 7/1981 | Katzman et al. | |
| 4,436,224 | A | 3/1984 | McInerny | |
| 4,630,756 | A | 12/1986 | Amici et al. | |
| 4,696,398 | A | 9/1987 | Steinmetz | |
| 4,932,563 | A * | 6/1990 | Diamond et al. | 222/129 |
| 5,018,449 | A | 5/1991 | Eidson, II | |
| 5,070,610 | A * | 12/1991 | Leslie | 29/899.1 |
| 5,071,387 | A | 12/1991 | Pottick | |
| 5,236,384 | A | 8/1993 | Fabricant et al. | |
| D342,557 | S | 12/1993 | Frick | |
| 5,277,642 | A | 1/1994 | Dorta | |
| 5,375,839 | A | 12/1994 | Pagani | |
| 5,377,996 | A | 1/1995 | Shure | |
| 5,785,633 | A | 7/1998 | Stroppiana | |
| 5,810,685 | A | 9/1998 | Willner et al. | |
| 5,819,989 | A | 10/1998 | Saraceni | |
| 5,992,757 | A | 11/1999 | Smith et al. | |
| 6,010,034 | A | 1/2000 | Walthers | |
| 6,042,022 | A | 3/2000 | Rogozinski et al. | |
| 6,138,874 | A | 10/2000 | Audrey | |
| 6,142,894 | A | 11/2000 | Lee | |
| D435,610 | S | 12/2000 | Kramer | |
| 6,269,566 | B1 | 8/2001 | Lo | |
| 6,279,778 | B1 | 8/2001 | Ho et al. | |
| 6,340,099 | B1 * | 1/2002 | Ho et al. | 222/78 |
| 6,415,534 | B1 | 7/2002 | Liao | |
| 6,431,405 | B2 | 8/2002 | Irwin | |
| 6,449,887 | B1 | 9/2002 | Song | |
| 6,537,125 | B1 * | 3/2003 | Motosko, III | 446/220 |
| 6,702,699 | B2 | 3/2004 | Touhey et al. | |
| D496,073 | S | 9/2004 | Kramer | |
| 7,014,565 | B2 | 3/2006 | Chang | |
| 7,033,178 | B2 | 4/2006 | Wood et al. | |
| 7,163,313 | B2 | 1/2007 | Rosenberg | |
| 7,168,599 | B1 | 1/2007 | Criswell et al. | |
| 7,185,787 | B2 | 3/2007 | Brown et al. | |
| 7,331,839 | B2 | 2/2008 | Diffley | |
| 7,475,832 | B2 | 1/2009 | Amron | |
| 7,475,932 | B2 * | 1/2009 | Milner et al. | 296/84.1 |
| 7,938,758 | B2 | 5/2011 | Publicover et al. | |
| 2004/0018924 | A1 | 1/2004 | Szydlowski et al. | |
| 2004/0191733 | A1 | 9/2004 | Wood et al. | |
| 2005/0035148 | A1 | 2/2005 | Zimmerman | |
| 2005/0233815 | A1 | 10/2005 | McCreary et al. | |
| 2008/0004112 | A1 | 1/2008 | Pines et al. | |
| 2008/0015064 | A1 | 1/2008 | Nelson et al. | |
| 2009/0130948 | A1 | 5/2009 | Deasy, II | |
| 2010/0016092 | A1 | 1/2010 | Amron | |

OTHER PUBLICATIONS

International Search Report of the International Searching Authority, mailed Jan. 26, 2007, for International Application No. PCT/US2006/033615.

* cited by examiner

HOPPING BALL

CROSS REFERENCE TO RELATED APPLICATIONS

This is a continuation of application Ser. No. 13/184,449, filed Jul. 15, 2011, which is a continuation of application Ser. No. 13/098,369, filed Apr. 29, 2011, which is a continuation of application Ser. No. 12/037,032, filed Feb. 25, 2008, now U.S. Pat. No. 7,938,758, which is a continuation-in-part of International Application No. PCT/US2006/033615, filed Aug. 28, 2006, which claims the benefit of U.S. Provisional Application No. 60/712,713, filed Aug. 30, 2005, all of which prior applications are incorporated herein by reference in their entireties.

BACKGROUND

The present invention relates to a play ball, particularly one having handles and suitable for hopping by a player seated thereon.

Oversized play balls are known in the art, in particular those of sufficient size to seat a player. The player grasps handles that are affixed to and extend from ball while they sit on the ball, and uses their legs to make repeated hops.

However, the well-known hopping ball has several disadvantages. In the first instance, the type of play is limited to hopping or bouncing. In another instance, the handles while necessary for the players to balance themselves on the ball, can present a hazard by trapping the hands or wrists when the player loses balance and falls off the ball. Many of these balls use inverted U-shaped handles that could easily trap a hand or arm and cause injury to it as the ball rolls over with the force of the bouncer's weight, especially when used with a trampoline whereon a bouncer can jump higher, generating more impact force. Further, when such balls are deployed on a trampoline rebounding surface they exhibit a tendency to slide or slip around, giving the bouncer less control.

SUMMARY

A large hopping ball having handles in the form of elongated elastic members extended from the balls surface, being disposed close to each other is disclosed.

A soft elastic ball having an array of mammillated protrusions extending from the lower surface is disclosed.

A disclosed elastic ball comprises a handle, which can be manipulated to activate squirt guns to shoot fluid. Either the fluid can be retained within the ball or a separate fluid-containing chamber attached to the ball or supplied to the ball via a pressurized hose.

Objects, effects, features, and advantages will become more apparent from the following description of the embodiments thereof taken in conjunction with the accompanying drawings.

DETAILED DESCRIPTION

Figure 1B:
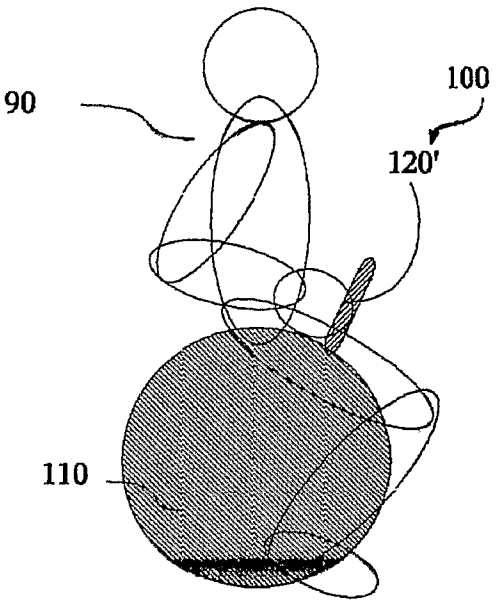
FIG. 1B is an elevation showing the position of a player on the ball during play.
Figure 1A:
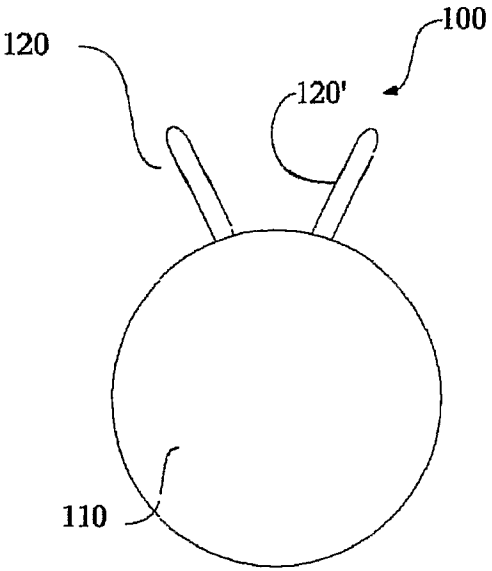
FIG. 1A is a perspective view of a first embodiment of a recreation and play ball.

A recreation and play ball 100 of FIG. 1A comprises a substantially spherical chamber 110 formed of an elastic body. The upper hemisphere of the chamber has attached thereto and extending radially there from a pair of elongated handles 120 and 120'. As shown in FIG. 1B. In FIG. 1B player 90 sit on the top of the ball, with the ball rotated such that when gripping handles 120 and 120' with each hand. The elastic body may be shaped in ways that are not substantially spherical. The ball or bouncing object may take on many shapes (shapes that mimic animals) as long it is an elastic body designed for the purpose of allowing a user bounce up and down on it.

Figure 2:
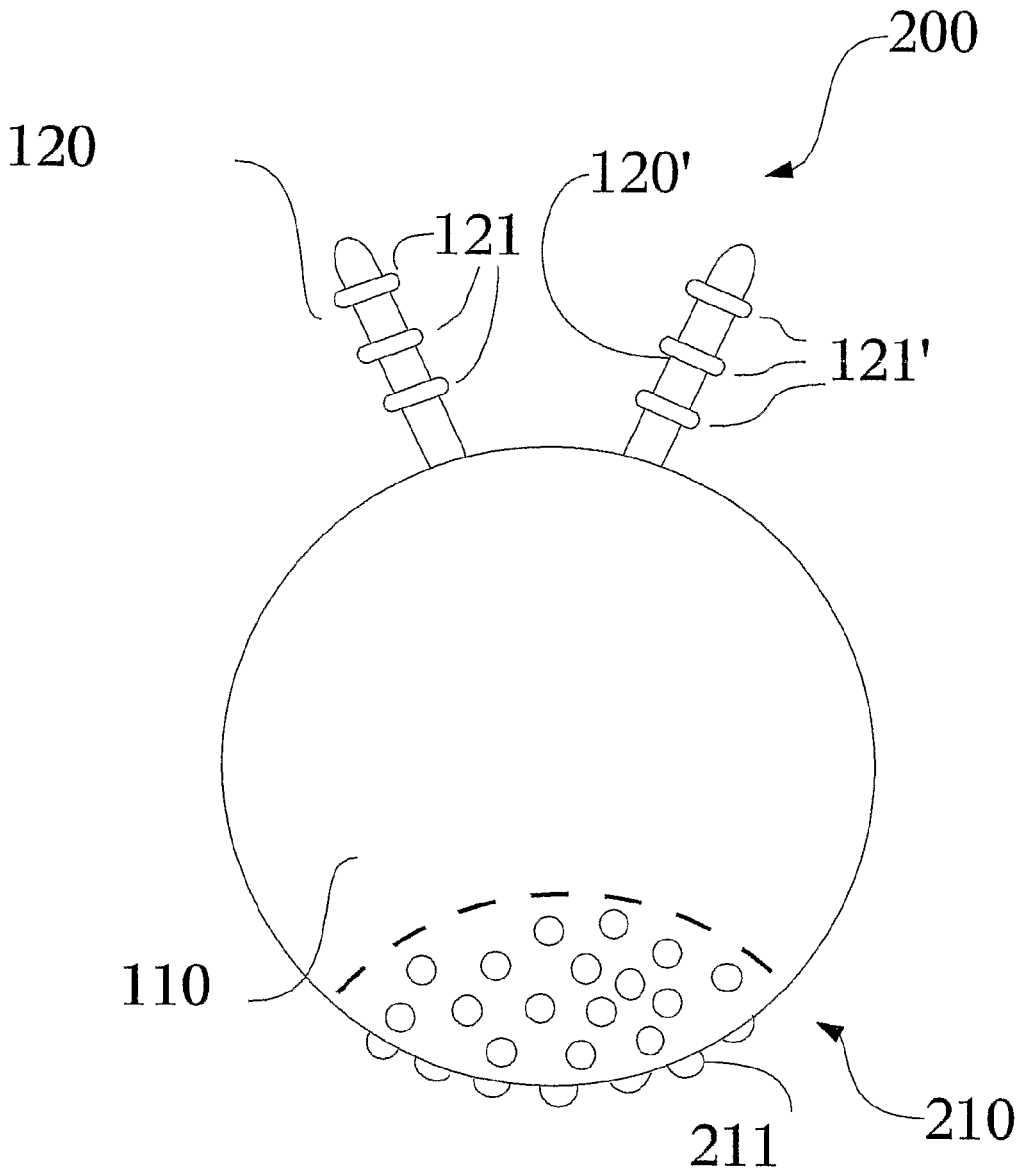
FIG. 2 is a perspective view of a second embodiment of a recreation and play ball.

The recreation and play ball 200 of FIG. 2 comprises an array of projections 210 about the lower portion 211 of the sphere opposite handle 120 and 120'. The hemispherical projection enhances the grip ability of the ball on a trampoline mat. Further, in this preferred embodiment, handles 120 and 121' are formed with an array of gripping rings 121 and 121 formed around the circumference of respective grips 120 and 120'.

A hopping play ball comprises a pair of elongated grips or handles adjacent to each other and extending radially outward from the surface of the ball. The ball may also comprise an array of mammillated protrusion on the lower surface opposite the handles to improve the stability during bouncing on an elastic surface, such as a trampoline rebounding mat.

In other embodiments, the ball has one or more water reservoirs in fluid communication with squirt nozzles disposed on either the surface of the ball or an outward facing portion of the handles. The squirt nozzles are activated by the player via hand manipulation, and may pump or squirt water in response to each bounce or may be triggered independent of the players bouncing movement.

In alternative embodiment, the hopping ball or elastic body on which to bounce has an external seat or pressurizing mechanism. Such internal pressuring systems are known in the art, specifically in U.S. Pat. No. 6,702,699, which is incorporated herein by reference. The mechanism is disposed within the hopping ball, but rather than collecting air that pressures the ball, the air is diverted to pump or pressurize a water reservoir, in particular as shown in the following embodiments, the air is injected into a fluid retaining chamber generally above the level of the fluid, or otherwise via a one way valve. A siphon tube is disposed with a first end below the nominal level of the fluid and a second end external to the ball, wherein the bouncing player optionally opens a valve in the siphon tube to squirt water. In one embodiment, the bouncing of the ball itself activates the pump, while in other embodiments the players independent bouncing on seat activates the internal air pump. The seat uses springs and/or a chamber(s) to inject air into a pressurizing chamber because of the user's bouncing activity. The chamber is connected to a fluid chamber or includes fluid. The chamber is connected to a valve that when actuated releases the fluid/air through a nozzle. The pressurizing mechanism can be located anywhere on the ball, but the bottom landing area and the top seating area are preferable.

Figure 3:
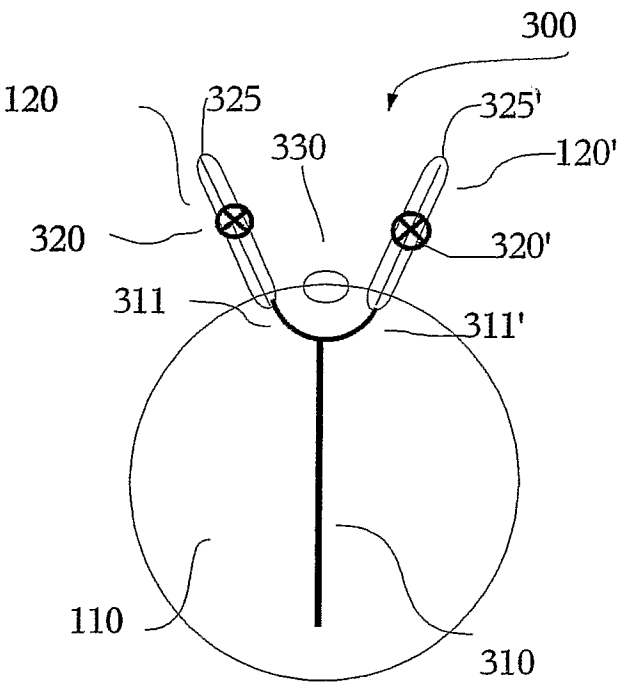
FIG. 3 is a cross-sectional elevation of a third embodiment of a recreation and play ball.

One such alternative embodiment is the recreation and play ball 300 illustrated in FIG. 3, comprises handles 120 and 120' having water squirt nozzles 325 and 325'. As shown in FIG. 3, the nozzles are situated near the end of the handles 325 and 325', but may be located anywhere on the bouncing object. Valves 320 and 320', disposed on handle 325 and 325' respectively, control the flow of fluid to nozzles 325 via tube 311. Tube 311 is in fluid communication with the center of sphere 110 via a manifold arrangement 311 that includes tube 310. Water is initially inserted into ball 300 via portal 330 located on the outer surface of the sphere. Thus, the player's bouncing on the ball builds instantaneous pressure for releasing water spray through the nozzles.

Figure 4:
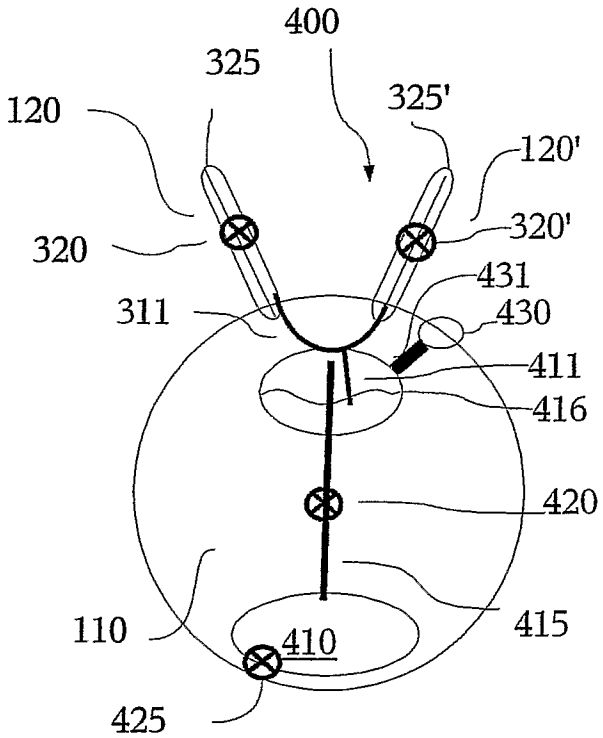
FIG. 4 is a cross-sectional elevation of a fourth embodiment of a recreation and play ball.

Another embodiment of a water-spraying play ball or elastic bouncing body 400 is illustrated in FIG. 4, in which water is stored in a separate reservoir 416 inside sphere 110. Reservoir 416 is substantially rigid to maintain a pressure that is higher than the inflation pressure of ball 400. Another elastic chamber 410 in the lower portion of the interior of sphere 110 acts as a pump to pressure the air in reservoir 416, via repeated compressions and expansions by the player's bouncing on the ball. In operation, chamber 420 admits outside air via valve 425, which responds to the negative pressure of expansion of the elastic walls. When the player bounces, compressing chamber 410 at the bottom of sphere 110, valve 425 closes while valve 420 opens, thus permitting the compressed air to flow into the water reservoir 416 via air supply tube 415. Note that valve 420 operates in the opposite manner of valve 420, that is closing when valve 425 is open. Reservoir 416 is filled with water via tube 431 connecting the upper portion of reservoir 416 with liquid filling portal 430. Liquid portal 430 include a pressure resistive screw or bayonet mount cap. Releasing, that is pressing, an actuator to open either of valves 320 and 320' permits the fluid in reservoirs 416 to flow to nozzles 325 or 325' via tube 411 and manifold 311. Thus, the player using ball 400 can generate pressure in 416 to squirt water by jumping on the ball.

It should be appreciated that as the mammillated surface aids in preventing slippage of the balls during such types of wet play with multiple players. The preferred embodiments of the balls in FIGS. 3 and 4 deploy such a construction on the lower surface area, the portion of the balls that impact the landing surface during use.

Figure 5:
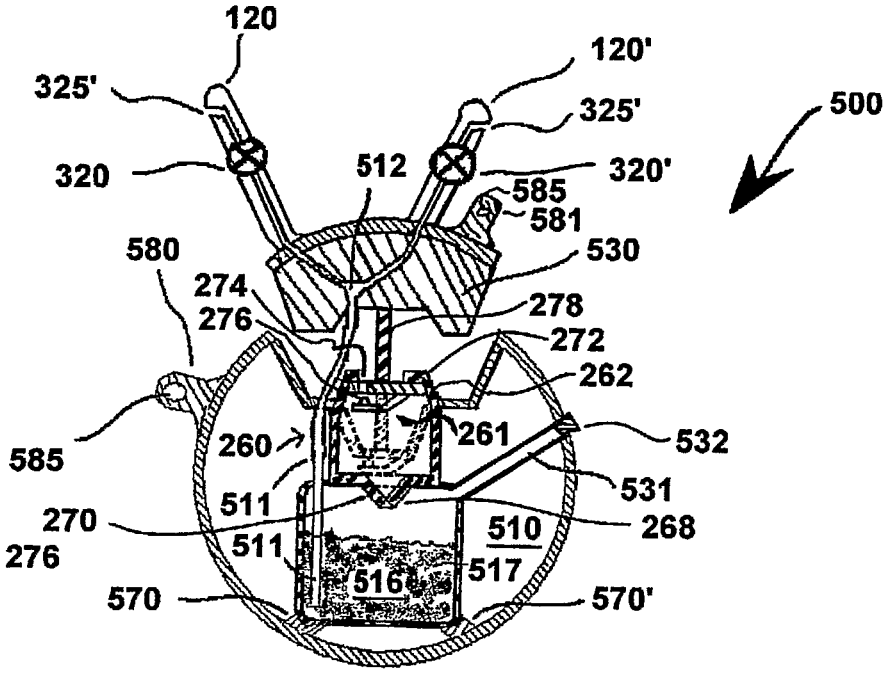
FIG. 5 is a cross-sectional elevation of another embodiment of a recreation and play ball for combining water play with hopping.

In another embodiment of water spraying play ball or elastic bouncing body 500 in FIG. 5, bouncing seat 530 is able to move up and down in response to the player's body motion independent of the movement of the remainder of the hopping ball or device. Again, water 517 or similar fluids are stored in a separate reservoir 516 inside sphere 510. Reservoir 516 is substantially rigid to maintain a pressure that is higher than the inflation pressure of ball 500. Reservoir 516 is filled with water via tube 531 connecting the upper portion of reservoir 516 with liquid filling portal 530, which is preferably by a pressure resistive screw or bayonet mount cap 532. The player's repeated bouncing activity actuates pump 260, that is the up and down movement of seat 530 operates air pump 260 via the reciprocating movement of piston rod 278 inside which has cylinder 261 formed from a flexible bladder 262. Thus, atmospheric air that enter cylinder 261 via opening 274 is discharging via duckbill valve 268 into the fluid retaining chamber 516. Note that reservoir 516 is supported within ball 500 from below by one or more internal supporting mounts, such as 570 and/or 570'.

The flexible bladder 262 of pump 260, which may be rubber or similar material, is sealed to an indented portion of ball carcass 264 at 266, that is below the position of seat 530, with the bladder 262 closed at the bottom end by the round plate 268 which contains a duckbill valve 270. The bladder 262 is attached at the top to the piston 272 having an opening 274 to the atmosphere and a flap valve 276. When the piston 272 is pushed down by the piston rod 278, from the position shown in FIG. 5, the flap valve 276 closes and the air is forced out of the bladder 262 through the duckbill valve 270 into the fluid reservoir 516. As the piston 272 is pushed down, the bladder flexes (and the top part follows the piston down inside of the bottom part into the position as shown by the dashed or phantom lines. When the piston is pulled up or urged up, due to either a contravening spring (not shown) or the elastic rebound of bladder 262, the flap valve 276 opens and the bladder 262 fills with air. Releasing, that is pressing, an actuator to open either of valves 320 and 320' permits the fluid 517 in reservoirs 516 to flow to nozzles 325 or 325' via tube 511 and manifold 512. Thus, the player straddling ball 500 can generate pressure in reservoir 516 to squirt water by jumping up and down on the ball via the seat portion 530.

FIG. 5 also illustrations another optional embodiment in which the hopping ball 500 or elastic body has internal or external protrusions that are used to connect various elements to the outside of the ball to modify the look of the ball or to connect various devices to increase play activities. Specifically, such, and 581, are illustrated in FIG. 5, on hopping ball 500. The protrusions are preferably integrally molded into the ball during fabrication, and more preferably include a bore 585 that passes from one side to the other to serve as an attachment point.

Figure 6A:
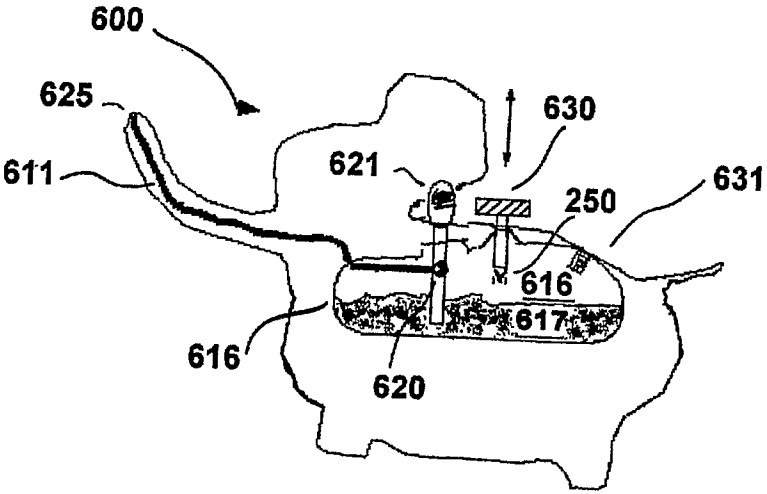
FIG. 6A is a cross-sectional elevation of another embodiment of a recreation and play ball for combining water play with hopping.

A similar embodiment of a play device 600 that departs from a substantially round shape is illustrated in FIG. 6. As the water spray function of this device is solely actuated by the up and down movement of seat 630, the operative principles are not dependent on the external shape of the device, which in this example, resembles an elephant, but may be of other animal or indeed fanciful and artificial shapes. Thus, for elephant shaped play device 600 water can be sprayed out of reservoir 616 via tube 611 in the trunk portion of the device. Reservoir 616 is filled with water via tube 631 connecting the upper portion of reservoir 616 with liquid filling portal 631. Liquid portal 631 include a pressure resistive screw or bayonet mount cap. According, once reservoir 616 is pressured by the seats actuation of pump 650, by releasing, that is pressing an actuator disposed on handle 621 to open valves 620, permits the fluid 617 in reservoirs 616 to flow to nozzles 625 via tube 611 that is connected to siphon tube 612 submerged below the surface of the water 617 in reservoir 616. Thus, the player using play device 600 can generate pressure in 616 to squirt water by bouncing on seat 630, which responds due to the energy alternatively stored and released in spring 252.

Figure 6B:
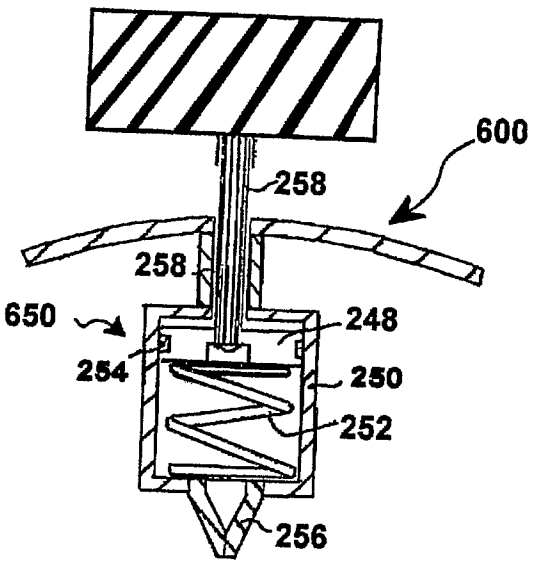
FIG. 6B is a detailed view of a portion of FIG. 6A.

FIG. 6B illustrates in further detail the operation of the air pump 650 that is responsive to movement of seat 630 in this arrangement. The air pump 650 comprises a piston 248 in cylinder 250 with the piston being forced up by the spring 252. The piston 248 is provided with a one-way flow O-ring arrangement 254 and the cylinder has the one-way flow duckbill 256. In this embodiment, the piston rod is attached to the bottom of external seat 630. The players up and down bouncing on the seat mechanically reciprocates the piston, drawing air from outside the device and through the one way flow O-ring arrangement 254, and pushing air into fluid containing chamber 616. Means not shown would be used to optionally lock the seat down. In addition to being able to pressurize the fluid containing chamber 617 by mechanically moving the seat, the chamber can be pressured with an external pump, such as a conventional tire pump, via fluid filling portal 631. The tire pump is merely attached in the normal manner to the valve stem formed in the cap or closure for filling portal 631, and is optionally used to pump up the ball just like an auto or bike tire.

Figure 7:
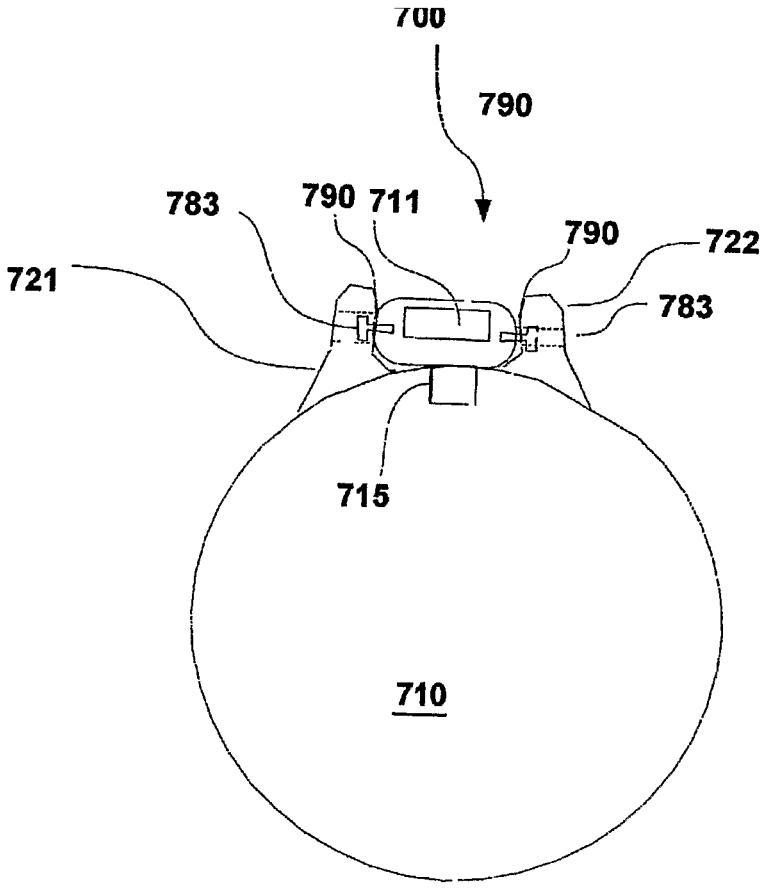
FIG. 7 is a cross-sectional elevation of another embodiment of a recreation and play ball for combining counting and related educational games with hoping.

In another embodiment of the hopping ball or bouncing elastic body is included a device(s) for counting and/or displaying the number of bounces by a user. Such device(s) can also be used to play a variety of number games while using the ball, and is illustrated in FIG. 7, as hopping ball 700.

An electronic counting and display module 710 is mounted externally to the hopping ball 700 using a first protrusion 781 and second protrusion 782 as mounts. Each protrusion as a through hole 783, through which is inserted a mounting screw 790 that fits a corresponding female threaded orifice on the side of the electronic module 710. Electronic module 710 is responsive to Pressure transducer 715 inside ball 700, and thus is operate to count or tally the jumps, producing a visual output that is apparent on the display 711 of electronic module 710. Further, the protrusion 781 and 782 used for mounting the electronic module may extend to serve as handles, or additional elongated or looped handles may be provided.

Figure 8:
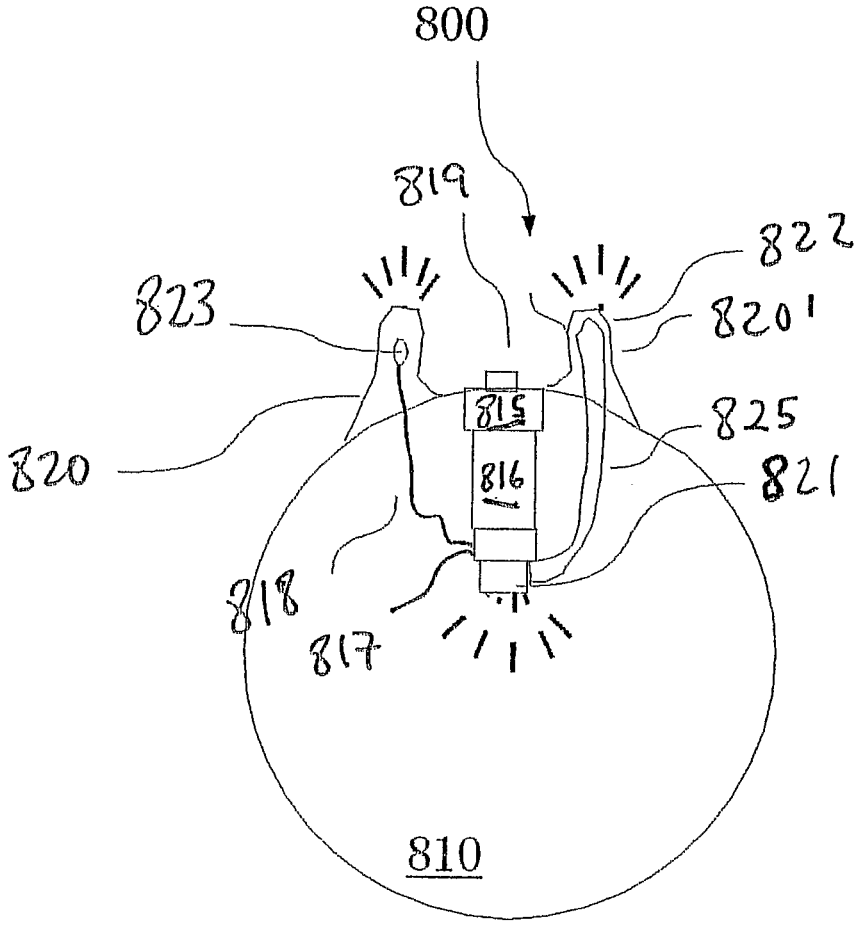
FIG. 8 is a cross-sectional elevation of another embodiment of a recreation and play ball that deploys lighting capabilities.

In another embodiment, the hopping ball or bouncing elastic body includes a device(s) for generating light in response to the players bouncing activity. Thus, as shown in FIG. 8, various lights are responsive to change in internal pressure as determined by transducer 8151 located with the interior 810 of ball 800. Batteries 816 power one of more of the alternative embodiments for lighting that is bulb 821 or 822.

Preferably, light bulb 823 is a light emitting diode embedded in transparent handle 820, which is connected to power supply 817 via cable 818. Power supply 817 is operative with respect to the output of pressure transducer 815 or the position of external switch 819 to supply current to one or more light bulbs, such as 821 or 822.

Light may be transferred by a fiber optic 825 or a conduit that operative to provide for total internal reflection of light, to the surface of the hopping ball, and in this example to the transparent handle 820'.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

Other embodiments for lighting a hopping ball or other device with a movable seat, such as illustrated in FIG. 5 or FIG. 6, include replacing the pressure transducer described with respect to FIG. 8 with micro-switch operative in response to the movement of the seat, piston or pump diagram and related components previously described.

Further, it should be understood that the various embodiments and features that are generally activated in response to the hopping of the ball are also optionally made response to the movement a seat with respect to the body of the device. More specifically, the device itself may be stationery whereas the bouncing action that actives the flow of water, counting device or activation of lights is responsive to the seat motion alone.

The invention claimed is:

1. A play apparatus comprising:

an inflatable elastic ball that is configured such that a user can sit on top of the ball and can bounce while sitting on top of the ball;

at least one reservoir defining a chamber adapted to contain a body of liquid;

at least one handle positioned to allow a user to grasp the play apparatus while sitting on top of the ball;

an array of mammillated protrusions on the landing surface portion of the ball to improve stability and inhibit slippage during bouncing;

at least one orifice disposed on an external surface of the play apparatus, the at least one orifice being in liquid communication with the chamber and being positioned to direct a stream of liquid to a location distant from the ball; and a pump mechanism that is activated by bouncing of the ball on a surface and that is operative to expel liquid contained in the chamber through the at least one orifice to a location distant from the ball.

2. The play apparatus of claim 1 wherein the mechanism operative to expel liquid includes an apparatus manipulatable by the user to control the flow of liquid from the chamber to the at least one orifice.

3. The play apparatus of claim 1 having a reservoir disposed inside the ball.

4. The play apparatus of claim 1 having more than one reservoir.

5. The play apparatus of claim 4 wherein the reservoirs are in liquid communication with the at least one orifice.

6. A play apparatus comprising:

an inflatable elastic ball that is configured such that a user can sit on top of the ball and can bounce while sitting on top of the ball;

at least one reservoir defining a chamber adapted to contain a body of liquid;

at least one handle positioned to allow a user to grasp the play apparatus while sitting on top of the ball;

at least one orifice disposed on an external surface of the play apparatus, the at least one orifice being in liquid communication with the chamber and being positioned to direct a stream of liquid to a location distant from the ball; and a pump mechanism that is activated by bouncing of the ball on a surface and that is operative to expel liquid contained in the chamber through the at least one orifice to a location distant from the ball.

7. A play apparatus comprising:

an inflatable elastic ball that is configured such that a user can sit on top of the ball and can bounce while sitting on top of the ball;

at least one reservoir defining a chamber adapted to contain a body of liquid;

at least one handle positioned to allow a user to grasp the play apparatus while sitting on top of the ball;

an array of mammillated protrusions on the landing surface portion of the ball to improve stability and inhibit slippage during bouncing;

at least one orifice disposed on an external surface of the play apparatus, the at least one orifice being in liquid communication with the chamber and being positioned to direct a stream of liquid to a location distant from the ball; and a pump mechanism that is operative to expel liquid contained in the chamber through the at least one orifice to a location distant from the ball.

* * * * *